US009068472B2

(12) United States Patent
Rawlinson et al.

(10) Patent No.: US 9,068,472 B2
(45) Date of Patent: Jun. 30, 2015

(54) ENDWALL COMPONENT FOR A TURBINE STAGE OF A GAS TURBINE ENGINE

(75) Inventors: Anthony J. Rawlinson, Derby (GB); Peter Ireland, Derby (GB); Lynne H. Turner, Bristol (GB); Ian Tibbott, Lichfield (GB)

(73) Assignee: ROLLS-ROYCE PLC, London (GB)

( * ) Notice: Subject to any disclaimer, the term of this patent is extended or adjusted under 35 U.S.C. 154(b) by 663 days.

(21) Appl. No.: 13/368,718

(22) Filed: Feb. 8, 2012

(65) Prior Publication Data

US 2012/0219401 A1 Aug. 30, 2012

(30) Foreign Application Priority Data

Feb. 24, 2011 (GB) ..... 1103176.2

(51) Int. Cl.

*F01D 5/18* (2006.01)
*F01D 9/06* (2006.01)
*F01D 11/08* (2006.01)
(Continued)

(52) U.S. Cl.

CPC ..... *F01D 25/12* (2013.01); *F01D 5/187* (2013.01); *F01D 11/08* (2013.01); *F01D 5/186* (2013.01); *F01D 9/06* (2013.01); *F05D 2240/81* (2013.01); *F05D 2260/20* (2013.01); *F01D 11/122* (2013.01); *F05D 2240/11* (2013.01); *F05D 2260/202* (2013.01)

(58) Field of Classification Search

CPC ..... F01D 5/182; F01D 5/186; F01D 5/187; F01D 11/08; F01D 11/12; F01D 11/122; F01D 11/124; F01D 25/12; F01D 9/06; F01D 9/065; F05D 2260/20; F05D 2260/202; F05D 2260/203; F05D 2240/81; F05D 2240/11

USPC ..... 415/115, 116, 173.1, 175–178; 416/96 R, 96 A, 97 R, 193 A

See application file for complete search history.

(56) References Cited

U.S. PATENT DOCUMENTS 3,365,172 A * 1/1968 Howald et al. ..... 415/117
3,542,486 A * 11/1970 Kercherr et al. ..... 416/90 R
(Continued)

FOREIGN PATENT DOCUMENTS

EP 2 136 034 A2 12/2009
EP 2 143 882 A2 1/2010
(Continued)

OTHER PUBLICATIONS

May 24, 2011 British Search Report issued in Patent Application No. GB1 103176.2.

*Primary Examiner* — Christopher Verdier
(74) *Attorney, Agent, or Firm* — Oliff PLC

(57) ABSTRACT

A component of a turbine stage of a gas turbine engine is provided, the component forming an endwall for the working gas annulus of the stage. The component has one or more internal plena behind the endwall which, in use, contain a flow of cooling air. The component further has a plurality of exhaust holes in the endwall. The holes connect the plena to a gas-washed surface of the endwall such that the cooling air effuses through the holes to form a cooling film over the gas-washed surface. Each exhaust hole has a flow cross-sectional area which is greater at an intermediate position between the entrance of the hole from the respective plenum and the exit of the hole to the gas-washed surface than it is at said exit.

9 Claims, 4 Drawing Sheets

(51) Int. Cl.
*F01D 25/12* (2006.01)
*F01D 11/12* (2006.01)

(56) References Cited

U.S. PATENT DOCUMENTS 4,526,226 A * 7/1985 Hsia et al. ..... 165/109.1
4,669,957 A 6/1987 Phillips et al.
4,770,608 A * 9/1988 Anderson et al. ..... 415/115
5,382,135 A * 1/1995 Green ..... 416/97 R
6,155,778 A * 12/2000 Lee et al. ..... 415/116
6,254,347 B1 * 7/2001 Shaw et al. ..... 416/97 R
7,097,417 B2 * 8/2006 Liang ..... 415/115
7,722,327 B1 * 5/2010 Liang ..... 416/97 R
7,775,769 B1 8/2010 Liang
7,866,948 B1 1/2011 Liang
2005/0175444 A1 8/2005 Liang

FOREIGN PATENT DOCUMENTS

GB 2 184 492 A 6/1987
GB 2 202 907 A 10/1988

* cited by examiner

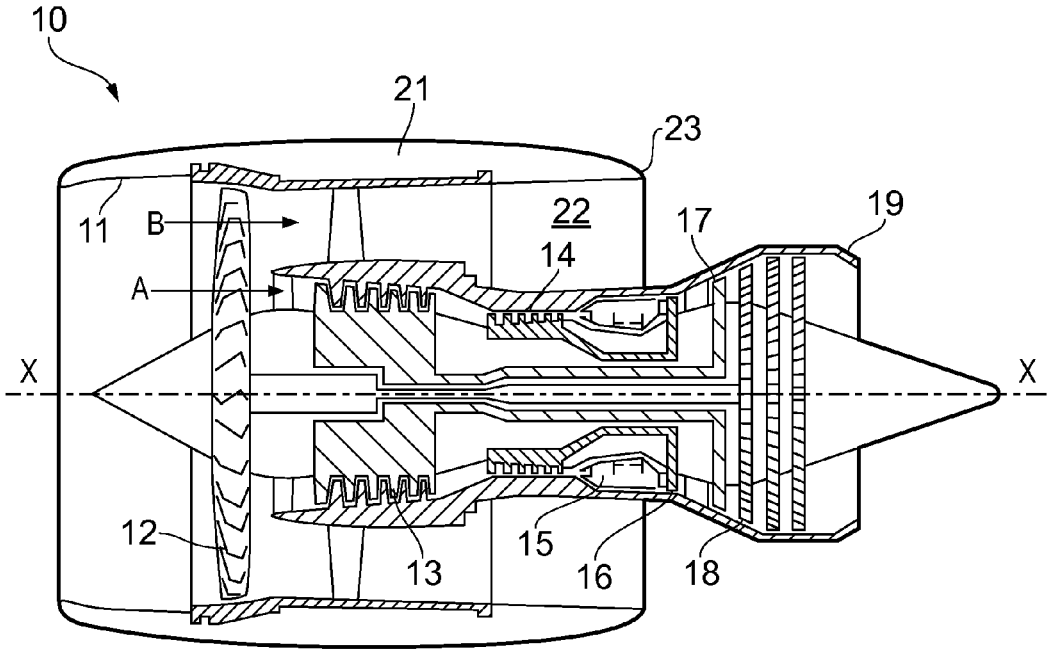
FIG. 1 -- Related Art

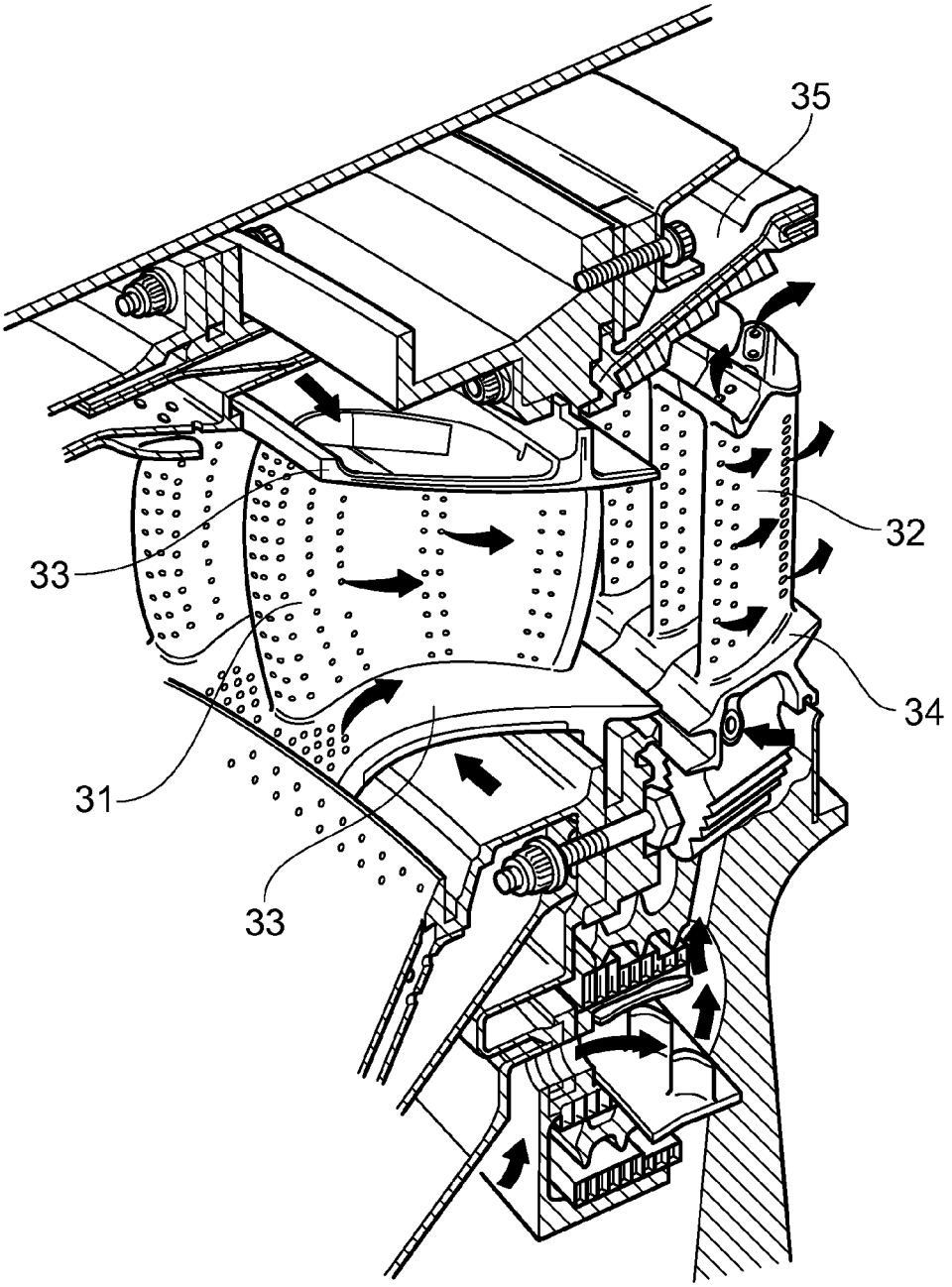
FIG. 2 -- Related Art

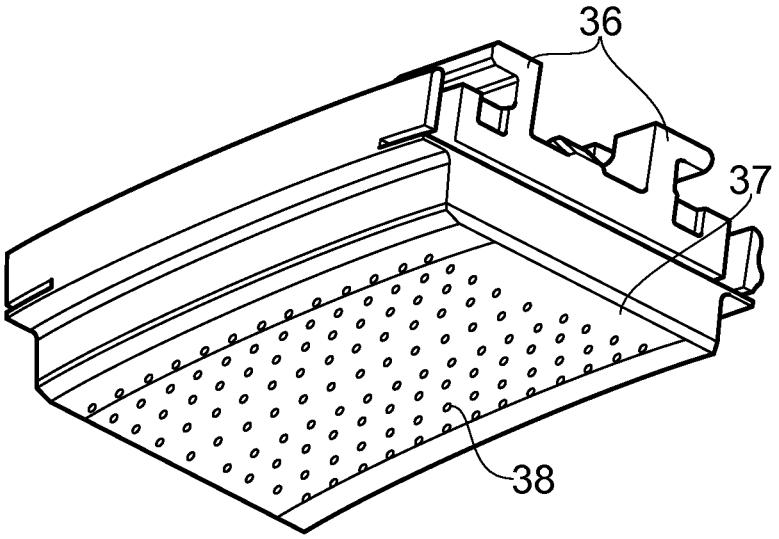
FIG. 3 -- Related Art
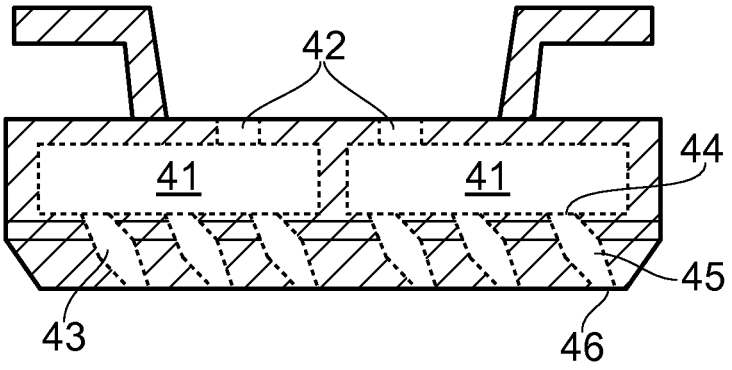
FIG. 4

ENDWALL COMPONENT FOR A TURBINE STAGE OF A GAS TURBINE ENGINE

The present invention relates to a component of a turbine stage of a gas turbine engine, the component forming an endwall for the working gas annulus of the stage.

With reference to FIG. 1, a ducted fan gas turbine engine generally indicated at 10 has a principal and rotational axis X-X. The engine comprises, in axial flow series, an air intake 11, a propulsive fan 12, an intermediate pressure compressor 13, a high-pressure compressor 14, combustion equipment 15, a high-pressure turbine 16, and intermediate-pressure turbine 17, a low-pressure turbine 18 and a core engine exhaust nozzle 19. A nacelle 21 generally surrounds the engine 10 and defines the intake 11, a bypass duct 22 and a bypass exhaust nozzle 23.

The gas turbine engine 10 works in a conventional manner so that air entering the intake 11 is accelerated by the fan 12 to produce two air flows: a first air flow A into the intermediate pressure compressor 14 and a second air flow B which passes through the bypass duct 22 to provide propulsive thrust. The intermediate pressure compressor 13 compresses the air flow A directed into it before delivering that air to the high pressure compressor 14 where further compression takes place.

The compressed air exhausted from the high-pressure compressor 14 is directed into the combustion equipment 15 where it is mixed with fuel and the mixture combusted. The resultant hot combustion products then expand through, and thereby drive the high, intermediate and low-pressure turbines 16, 17, 18 before being exhausted through the nozzle 19 to provide additional propulsive thrust. The high, intermediate and low-pressure turbines respectively drive the high and intermediate pressure compressors 14, 13 and the fan 12 by suitable interconnecting shafts.

The performance of gas turbine engines, whether measured in terms of efficiency or specific output, is improved by increasing the turbine gas temperature. It is therefore desirable to operate the turbines at the highest possible temperatures. For any engine cycle compression ratio or bypass ratio, increasing the turbine entry gas temperature produces more specific thrust (e.g. engine thrust per unit of air mass flow). However as turbine entry temperatures increase, the life of an un-cooled turbine falls, necessitating the development of better materials and the introduction of internal air cooling.

In modern engines, the high-pressure turbine gas temperatures are hotter than the melting point of the material of the blades and vanes, necessitating internal air cooling of these airfoil components. During its passage through the engine, the mean temperature of the gas stream decreases as power is extracted. Therefore, the need to cool the static and rotary parts of the engine structure decreases as the gas moves from the high-pressure stage(s), through the intermediate-pressure and low-pressure stages, and towards the exit nozzle.

FIG. 2 shows an isometric view of a typical single stage cooled turbine. Cooling air flows are indicated by arrows.

Internal convection and external films are the prime methods of cooling the gas path components—airfoils, platforms, shrouds and shroud segments etc. High-pressure turbine nozzle guide vanes 31 (NGVs) consume the greatest amount of cooling air on high temperature engines. High-pressure blades 32 typically use about half of the NGV flow. The intermediate-pressure and low-pressure stages downstream of the HP turbine use progressively less cooling air.

The high-pressure turbine airfoils are cooled by using high pressure air from the compressor that has by-passed the combustor and is therefore relatively cool compared to the gas temperature. Typical cooling air temperatures are between 800 and 1000 K, while gas temperatures can be in excess of 2100 K.

The cooling air from the compressor that is used to cool the hot turbine components is not used fully to extract work from the turbine. Therefore, as extracting coolant flow has an adverse effect on the engine operating efficiency, it is important to use the cooling air effectively.

Ever increasing gas temperature levels combined with a drive towards flatter combustion radial profiles, in the interests of reduced combustor emissions, have resulted in an increase in local gas temperature experienced by the working gas annulus endwalls, which include NGV platforms 33, blade platforms 34 and shroud segments 35 (also known as shroud liners). However, the flow of air that is used to cool these endwalls can be highly detrimental to the turbine efficiency. This is due to the high mixing losses attributed to these cooling flows when they are returned to the mainstream working gas path flow, in particular when the air exhausts behind turbine blades.

FIG. 3 shows an isometric view of a typical high-pressure turbine shroud segment. The segment, which is mounted to an external casing by legs 36, provides an endwall 37 for the working gas annulus, an abradable coating being formed on the gas-washed surface of the endwall. A plurality of effusion exhaust holes 38 are formed in the endwall, cooling air passing from an internal plenum or plena through the holes to form a cooling film on the gas-washed surface.

The pressure of the cooling air in the plenum or plena must be kept above the hot gas annulus pressure to prevent ingestion. In the case of a shroudless turbine blade there is a pulse of high pressure as the blade passes over the shroud segment. The plenum pressure must be kept above the peak of the pulse if ingestion of hot gas is to be avoided. However, between peaks, the excess plenum pressure can lead to excessive cooling air flow and hence can reduce engine operating efficiency.

An aim of the present invention is to provide a turbine stage endwall component which can operate at lower plenum pressures while avoiding the detrimental effects of hot gas ingestion.

Accordingly, the present invention provides a component of a turbine stage of a gas turbine engine, the component forming an endwall for the working gas annulus of the stage, and the component having:

one or more internal plena behind the endwall which, in use, contain a flow of cooling air, and a plurality of exhaust holes in the endwall, the holes connecting the plena to a gas-washed surface of the endwall such that the cooling air effuses through the holes to form a cooling film over the gas-washed surface;

wherein each exhaust hole has a flow cross-sectional area which is greater at an intermediate position between the entrance of the hole from the respective plenum and the exit of the hole to the gas-washed surface than it is at the exit.

Conventionally, exhaust holes are formed as straight cylinders having a constant flow cross-sectional area from entrance to exit. However, advantageously, by having an increased flow cross-sectional area away from their exits, the exhaust holes can have an increased fill volume, leading to expansion and pressure loss of any ingested hot gas. In this way, the time taken for the hot gas to penetrate the endwall after a pressure pulse can be increased, which in turn allows the pressure of cooling air in the plenum or plena to be reduced so that component can be operated at a lower average cooing air feed to exhaust pressure ratio.

The component may have any one or, to the extent that they are compatible, any combination of the following optional features.

The flow cross-sectional area may be greater at the intermediate position than it is at the exit by a factor of at least 1.5, and preferably by a factor of at least 2 or 4.

Preferably, the flow cross-sectional area is also greater at the intermediate position than it is at the entrance. In this way, any ingested hot gas can be better contained in the holes. The flow cross-sectional area may be greater at the intermediate position than it is at the entrance by a factor of at least 1.5, and preferably by a factor of at least 2 or 4.

The component may be a shroud segment providing a close clearance to the tips of a row of turbine blades which sweep across the segment. Such segments experience pressure pulses as they are swept over by the blades, and thus can benefit from such exhaust holes.

However, other turbine stage components can also experience hot gas pressure variations, e.g. due to vortex shedding from upstream structures. Thus the component may be a turbine blade, an inner platform of the blade forming the endwall. Alternatively, the component may be a static guide vane, an inner and/or an outer platform of the vane forming the endwall.

Embodiments of the invention will now be described by way of example with reference to the accompanying drawings in which:

FIG. 1 shows a schematic longitudinal cross-section through a ducted fan gas turbine engine;

FIG. 2 shows an isometric view of a typical single stage cooled turbine;

FIG. 3 shows an isometric view of a typical high-pressure turbine shroud segment;

FIG. 4 shows a schematic cross-sectional view through a high-pressure turbine shroud segment according to a first embodiment;

Figure 5:
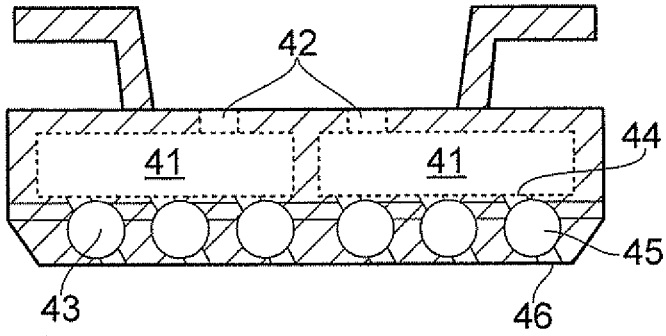
FIG. 5 shows a schematic cross-sectional view through a high-pressure turbine shroud segment according to a second embodiment.

FIG. 4 shows a schematic cross-sectional view through a high-pressure turbine shroud segment according to a first embodiment. The shroud segment has an endwall which forms a gas-washed surface for the working gas annulus of an engine. Internal plena 41 are formed behind the endwall, the plena containing a flow of cooling air introduced into the plena through feed holes 42. In FIG. 4 two plena are shown, but the number could be as low as one or perhaps as high as five or six. A plurality of exhaust holes 43 traverse the endwall, each hole has an entrance 44 which receives cooling air from the plena and an exit 46 at the gas-washed surface from which the cooling air effuses to form a cooling layer over the gas-washed surface.

Each exhaust hole 43 expands in flow cross-sectional area from its entrance 44 to a maximum area at an intermediate position 45, and then contracts in flow cross-sectional area to its exit 46. The flow cross-sectional area at the intermediate position can be greater than the flow cross-sectional area at the entrance and/or the exit by a factor of at least 1.5, and preferably by a factor of at least 2 or 4.

There is a pulse of high pressure in the hot working gas as each turbine blade passes over the shroud segment. Due to their increased flow cross-sectional area at the intermediate position 45, the exhaust holes 43 have high internal volumes relative to conventional straight exhaust holes. Accordingly, flow of ingested hot gas through each exhaust hole 43 has to expand at the intermediate position. This in turn produces an increased pressure loss when the hot gas enters the exhaust hole. This pressure loss helps to retain the ingested hot gas in the exhaust holes for a given pressure of the cooling air in the plena. That is, the cooling air in the plena is maintained at a pressure which prevents hot gas ingestion into the plena at the peak of each pressure pulse, but by adopting exhaust holes of the type shown in FIG. 4 that pressure can be reduced, leading to consequent improvements in engine efficiency. Some hot gas ingestion into the exhaust holes occurs, but as long as the hot gas is prevented from mixing with the cooling gas in the plena, that hot gas is simply ejected from the holes after the peak of the pressure pulse is passed.

FIG. 5 shows a schematic cross-sectional view through a high-pressure turbine shroud segment according to a second embodiment. Corresponding features in FIGS. 4 and 5 have the same reference numbers. In the second embodiment, as in the first, each exhaust hole 43 expands in flow cross-sectional area from its entrance 44 to a maximum area at an intermediate position 45, and then contracting in flow cross-sectional area to its exit 46. However, in the first embodiment, the expansion and contraction is caused by the cavity of each exhaust hole being formed as a pair of base-to-base frustocones. In contrast, in the second embodiment, the expansion and contraction is caused by the cavity being formed by two short cylindrical sections joined together by a large diameter sphere. Other shapes for the cavity can also be adopted, e.g. depending on manufacturing convenience.

Figure 6:
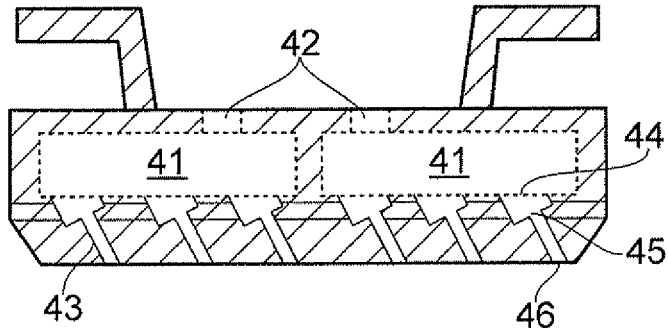
FIG. 6 shows a schematic cross-sectional view through a further high-pressure turbine shroud segment according to a third embodiment.

In the first and second embodiments, the expansion in flow cross-sectional area from the entrance 44 to the intermediate position 45 helps to retain the hot gas within the exhaust holes 43. However, such an expansion is not always necessary. FIG. 6 shows a schematic cross-sectional view through a high-pressure turbine shroud segment according to a third embodiment. Corresponding features in FIGS. 4 to 6 have the same reference numbers. In the third embodiment, the cavity of each exhaust hole 43 is formed by two end-to end cylinders, the interior cylinder having a greater diameter than the exterior cylinder. In this way, the hole contracts in flow cross-sectional area from its intermediate position 45 to its exit 46, but has a constant flow cross-sectional area from its entrance 44 to its intermediate position. Ingested hot gas experiences an expansion and pressure loss, and can thus still be detained in the holes.

While the invention has been described in conjunction with the exemplary embodiments described above, many equivalent modifications and variations will be apparent to those skilled in the art when given this disclosure. Accordingly, the exemplary embodiments of the invention set forth above are considered to be illustrative and not limiting. Various changes to the described embodiments may be made without departing from the spirit and scope of the invention.

The invention claimed is:

1. A component of a turbine stage of a gas turbine engine, the component forming an endwall for a working gas annulus of the turbine stage, and the component having:

one or more internal plena behind the endwall which, in use, contain a flow of cooling air, and a plurality of exhaust holes in the endwall, the exhaust holes connecting the one or more internal plena to a gas-washed surface of the endwall such that the cooling air effuses through the exhaust holes to form a cooling film over the gas-washed surface;

wherein:

each exhaust hole has a flow cross-sectional area which is greater at an intermediate position between the entrance of the exhaust hole from a respective plenum of the one or more internal plena and the exit of the exhaust hole to the gas-washed surface, the entrance, the intermediate position, and the exit of each of the exhaust holes are coaxial, and the flow cross-sectional area at the intermediate position of each of the exhaust holes being greater than both (i) a cross-sectional area of the entrance of each of the exhaust holes and (ii) a cross-sectional area of the exit of each of the exhaust holes, wherein a cavity of each exhaust hole being formed by a pair of base-to-base frustocones.

2. A component according to claim 1, wherein the flow cross-sectional area is greater at the intermediate position than it is at said exit by a factor of at least 1.5.

3. A component according to claim 1, wherein the flow cross-sectional area is greater at the intermediate position than it is at said entrance by a factor of at least 1.5.

4. A component according to claim 1 which is a shroud segment providing a close clearance to the tips of a row of turbine blades which sweep across the segment.

5. A component of a turbine stage of a gas turbine engine, the component forming an endwall for a working gas annulus of the turbine stage, and the component having:

one or more internal plena behind the endwall which, in use, contain a flow of cooling air, and a plurality of exhaust holes in the endwall, the exhaust holes connecting the one or more internal plena to a gas-washed surface of the endwall such that the cooling air effuses through the exhaust holes to form a cooling film over the gas-washed surface;

wherein:

each exhaust hole has a length with an entrance at a first end of the exhaust hole and an exit at a second end of the exhaust of hole and a flow cross-sectional area which is greater at an intermediate position of the exhaust hole between the first end and the second end, wherein the entrance at the first end of the exhaust hole communicates directly with a respective plenum of the one or more internal plena and the exit at the second end of the exhaust hole communicates directly with the gas-washed surface, wherein a cavity of each exhaust hole being formed by a pair of base-to-base frustocones.

6. A component of a turbine stage of a gas turbine engine, the component forming an endwall for a working gas annulus of the turbine stage, and the component having:

one or more internal plena behind the endwall which, in use, contain a flow of cooling air, and a plurality of exhaust holes in the endwall, the exhaust holes connecting the one or more internal plena to a gas-washed surface of the endwall such that the cooling air effuses through the exhaust holes to form a cooling film over the gas-washed surface;

wherein:

each exhaust hole has a flow cross-sectional area which is greater at an intermediate position between the entrance of the exhaust hole from the respective plenum and the exit of the exhaust hole to the gas-washed surface, wherein each exhaust hole expands in a flow cross-sectional area from the entrance of the exhaust hole to a maximum area at the intermediate position and then contracts in flow cross-sectional area to the exit of the exhaust hole, wherein a cavity of each exhaust hole being formed by a pair of base-to-base frustocones.

7. A component according to claim 6, wherein the flow cross-sectional area is greater at the intermediate position than it is at said exit by a factor of at least 1.5.

8. A component according to claim 6, wherein the flow cross-sectional area is greater at the intermediate position than it is at said entrance by a factor of at least 1.5.

9. A component according to claim 6 which is a shroud segment providing a close clearance to the tips of a row of turbine blades which sweep across the segment.

* * * * *